US008459765B2

(12) United States Patent
Harada

(10) Patent No.: US 8,459,765 B2
(45) Date of Patent: Jun. 11, 2013

(54) LIQUID EJECTING APPARATUS

(75) Inventor: Koji Harada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 303 days.

(21) Appl. No.: 12/907,789

(22) Filed: Oct. 19, 2010

(65) Prior Publication Data

US 2011/0090270 A1 Apr. 21, 2011

(30) Foreign Application Priority Data

Oct. 20, 2009 (JP) ..... 2009-241141

(51) Int. Cl.
*B41J 29/38* (2006.01)
*B41J 2/17* (2006.01)

(52) U.S. Cl.
USPC ..... 347/9; 347/84; 347/85

(58) Field of Classification Search
USPC ..... 347/6–7, 9, 84–86
See application file for complete search history.

(56) References Cited

U.S. PATENT DOCUMENTS

| | | | | |
|---|---|---|---|---|
| 5,963,236 | A | 10/1999 | Miyashita et al. | |
| 7,014,286 | B2 | 3/2006 | Yonekubo | |
| 2007/0273733 | A1 * | 11/2007 | Kotaki et al. | 347/85 |

FOREIGN PATENT DOCUMENTS

| | | | |
|---|---|---|---|
| JP | 08-207315 | A | 8/1996 |
| JP | 08-281967 | A | 10/1996 |
| JP | 2002-234196 | A | 8/2002 |
| JP | 2004-074590 | A | 3/2004 |
| JP | 2004-358668 | A | 12/2004 |

* cited by examiner

*Primary Examiner* — Jason Uhlenhake
(74) *Attorney, Agent, or Firm* — Kilpatrick Townsend & Stockton LLP

(57) ABSTRACT

A liquid ejecting apparatus that ejects a liquid containing a sedimentary component from an ejection nozzle provided in an ejection head includes: a liquid channel that conducts the liquid to the ejection head; a liquid discharge unit that discharges the liquid from the ejection nozzle. The liquid channel is provided with a first channel region and a second channel region; and the liquid discharge unit discharge a predetermined amount of the liquid from the ejection nozzle in the case where the amount of time that has elapsed a predetermined threshold time.

3 Claims, 8 Drawing Sheets

THRESHOLD TIME ELAPSED

PREDETERMINED AMOUNT SUCKED

THRESHOLD TIME ELAPSED

PREDETERMINED AMOUNT SUCKED

LIQUID EJECTING APPARATUS

This application claims priority to Japanese Patent Application No. 2009-241141, filed Oct. 20, 2010, the entirety of which is incorporated by reference herein.

BACKGROUND

1. Technical Field

The present invention relates to techniques for ejecting liquid from an ejection nozzle.

2. Related Art

Liquid ejecting apparatuses that eject liquid such as ink from an ejection head in which fine ejection nozzles are provided are known. With such a liquid ejecting apparatus, the liquid to be ejected (ink, for example) is held in a dedicated receptacle (an ink cartridge, for example), and the liquid within the receptacle is ejected by supplying that liquid to the ejection head via a flow channel.

Meanwhile, there are situations where sedimentary components are used as components in the liquid to be ejected. For example, in the case of ink, pigments are used in order to increase the so-called climate resistance or improve the color development properties of the ink. Because pigments are suspended rather than dissolved within the carrier (water, alcohol, or the like) of the ink, a pigment will settle within the carrier if the ink is left standing for an extended period of time. As a result, areas of high pigment density and areas of low pigment density occur within the ink, which makes it impossible to print images properly.

Accordingly, a technique has been proposed for an ink jet printer that includes ink containing sedimentary components (called "sedimentary ink" hereinafter) in which, when it has been determined that settling has occurred in the ink within an ejection head, the ink in which the settling has advanced is discharged by sucking the ink from an ejection nozzle (JP-A-2002-234196 is an example of related art.).

However, the settling of components contained within the liquid (ink or the like) to be ejected occurs not only within the ejection head, but also within the flow channels that supply the liquid from the holding receptacles to the ejection head. Although settling occurring in the flow channels does improve to an extent by the time the liquid has passed through the flow channels and reached the ejection head, there are cases where the settling has advanced to a point where it cannot be corrected; in such a case, it is necessary to discharge not only the liquid within the ejection head, but also the liquid within the flow channels, which is problematic in that a large amount of liquid is wasted. In particular, with a type of liquid ejecting apparatus in which a dedicated receptacle that holds the liquid is provided in a location that is far away from the ejection head and the liquid is supplied to the ejection head via a long tube or the like, a large amount of liquid is present within the tube and must be discharged, and thus the stated problem is even more marked.

SUMMARY

It is an advantage of some aspects of the invention to provide a technique that is capable of suppressing the discharge of a liquid to be ejected without using that liquid, even in the case where components contained in the liquid have settled.

In order to solve at least some of the aforementioned problems, a liquid ejecting apparatus according to the invention employs the following configuration. In other words, a liquid ejecting apparatus according to an aspect of the invention is a liquid ejecting apparatus that ejects a liquid containing a sedimentary component from an ejection nozzle provided in an ejection head, and includes: a liquid holding receptacle in which the liquid is held; a liquid channel that conducts the liquid within the liquid holding receptacle to the ejection head; a liquid discharge unit that discharges the liquid within the ejection head from the ejection nozzle; and a time measurement unit that measures the amount of time that has elapsed following the ejection or the discharge of the liquid. The liquid channel is provided with a first channel region in which the channel direction of the liquid channel is formed in a direction approximately perpendicular to the direction in which components in the liquid settle and a second channel region, located upstream from the first channel region, in which the channel direction of the liquid channel is formed, compared to the first channel region, along the direction in which components in the liquid settle; and the liquid discharge unit is a unit that moves liquid from the second channel region to the first channel region by discharging a predetermined amount of the liquid from the ejection nozzle in the case where the amount of time that has elapsed as measured by the time measurement unit has reached a predetermined threshold time.

With the liquid ejecting apparatus according to this aspect of the invention, the liquid within the liquid holding receptacle is conducted to the ejection head via the liquid channel and is then ejected from the ejection nozzle. Meanwhile, it is possible for the liquid that has been conducted to within the ejection head for ejection from the ejection nozzle to be unnecessarily discharged from the ejection nozzle without actually being ejected. Here, although the terms "ejection" and "discharge" are the same in that both refer to liquid flowing from the ejection nozzle, "ejection" in this specification refers to causing liquid to flow from the ejection nozzle for the original purpose of the liquid ejecting apparatus, whereas "discharge" refers to causing liquid to flow from the ejection nozzle in cases aside from "ejection". Furthermore, the first channel region, in which the channel direction is approximately perpendicular to the direction in which the sedimentary components contained in the liquid settle (the settling direction), and the second channel region, which is further upstream than the first channel region (that is, on the side of the liquid holding receptacle) and in which the channel direction is close to the settling direction compared to the first channel region (that is, follows the settling direction), are formed in the liquid channel spanning from the liquid holding receptacle to the ejection head. When the ejection or discharge of liquid from the ejection nozzle ends, the measurement of the amount of time that has elapsed commences, and in the case where the amount of time that has elapsed has reached the predetermined threshold time, the liquid in the second channel region is moved to the first channel region by discharging the predetermined amount of liquid from the ejection nozzle. Note that the amount of liquid discharged from the ejection nozzle (in other words, the predetermined amount) may be an amount that enables the liquid in the second channel region to move to the first channel region, and as little as an amount equivalent to the amount of liquid present in the second channel region may be used as the predetermined amount.

Although the mechanism will be described in detail later, settling of the liquid occurring in the first channel region is eliminated to a significant degree by the time the liquid flows through the liquid channel and reaches the ejection head. On the other hand, settling occurring in the second channel region is not eliminated by the liquid flowing in the liquid channel, and thus problems arise in the ejection of the liquid if the settling in the second channel region advances. In order to circumvent this problem, it is necessary to discharge the liquid in the second channel region prior to ejecting the liquid, but in order to do so, it is necessary to discharge all of the liquid within the liquid channel further downstream from the second channel region (that is, on the side of the ejection head) and within the ejection head. As opposed to this, with the liquid ejecting apparatus according to the invention, the liquid in the second channel region is moved to the first channel region after the predetermined threshold time has passed following the ejection or discharge of the liquid from the ejection nozzle, thus making it possible to suppress settling of the liquid that is present in the second channel region. Accordingly, it is no longer necessary to discharge all of the liquid that is downstream from the second channel region (that is, on the side of the ejection head) prior to ejecting the liquid, which makes it possible to greatly suppress the amount of liquid that is wastefully discharged.

Note that the second channel region mentioned here can be broadly interpreted as referring to the area in the liquid channel in which the channel direction is close to the settling direction, as compared to the first channel region. This is because compared to the first channel region, if the channel direction is close to the settling direction, the sedimentary components within the liquid move in the channel direction when such settling occurs. However, the second channel region can be more narrowly interpreted as referring to the area in the liquid channel in which the channel direction is closer to the settling direction than the direction perpendicular to the settling direction. The reason for this is that in such areas of the liquid channel, the amount of sedimentary component movement is greater in the channel direction than in the cross-sectional direction of the channel. In the case where the second channel region is interpreted according to this narrow definition, a type of buffer region arises between the second channel region and the first channel region; however, even in such a case, it is possible to greatly suppress the amount of liquid that is wastefully discharged by moving the liquid in the second channel region to the first channel region. Furthermore, the amount of liquid discharged from the ejection nozzle at this time (that is, the predetermined amount) can be freely set within a range spanning from the amount of liquid present in the second channel region according to the aforementioned narrow definition to the amount of liquid present in the second channel region according to the aforementioned broad definition. Of course, a greater amount of liquid may be discharged as necessary.

Meanwhile, in the liquid ejecting apparatus according to the invention described above, the total volume within the liquid channel downstream from the second channel region (that is, on the side of the ejection head) and the area in which liquid is supplied within the ejection head may be set to be a greater volume than the volume within the second channel region.

According to this aspect of the invention, the liquid within the second channel region is not discharged from the ejection nozzle when the liquid in the second channel region is moved to the first channel region. Accordingly, the next time liquid is ejected, the liquid that has been moved from the second channel region can be ejected, and thus it is possible to put the liquid within the liquid channel to use without waste.

Furthermore, in the liquid ejecting apparatus according to the invention described above, the liquid within the ejection head may be discharged in the following manner. First, a cap member that makes contact with an area in which the ejection nozzle is formed in the outer surface of the ejection head (that is, a nozzle surface) and that forms a closed space around the ejection nozzle as a result of this contact is provided. Furthermore, a suction pump that is connected to the cap member and that instigates negative pressure within the closed space is provided as well. Liquid may then be discharged by operating the suction pump in a state in which the cap member is in contact with the nozzle surface of the ejection head and sucking the liquid from the ejection nozzle through the negative pressure.

If such a cap member is provided, it is possible to suppress the liquid from drying through the ejection nozzle by bringing the cap member into contact with the nozzle surface during periods when liquid is not being ejected. Furthermore, even in the case where the amount of time that has elapsed has reached the threshold time and liquid is to be discharged, the predetermined amount of liquid can be discharged with ease simply by operating the suction pump while the cap member is in contact with the nozzle surface.

BRIEF DESCRIPTION OF THE DRAWINGS

The invention will be described with reference to the accompanying drawings, wherein like numbers reference like elements.

FIG. 2 is a descriptive diagram illustrating the general configuration of a driving unit for moving an ejection head back and forth, a paper feed unit for feeding a roll of paper, and so on.

DESCRIPTION OF EXEMPLARY EMBODIMENTS

Hereinafter, an embodiment of the invention will be described according to the following order in order to clarify the content of the invention.

A. Apparatus Configuration

B. Outline of Printing Operations

C. Standing Ink Management Process According to Embodiment

A. Apparatus Configuration

Figure 1:
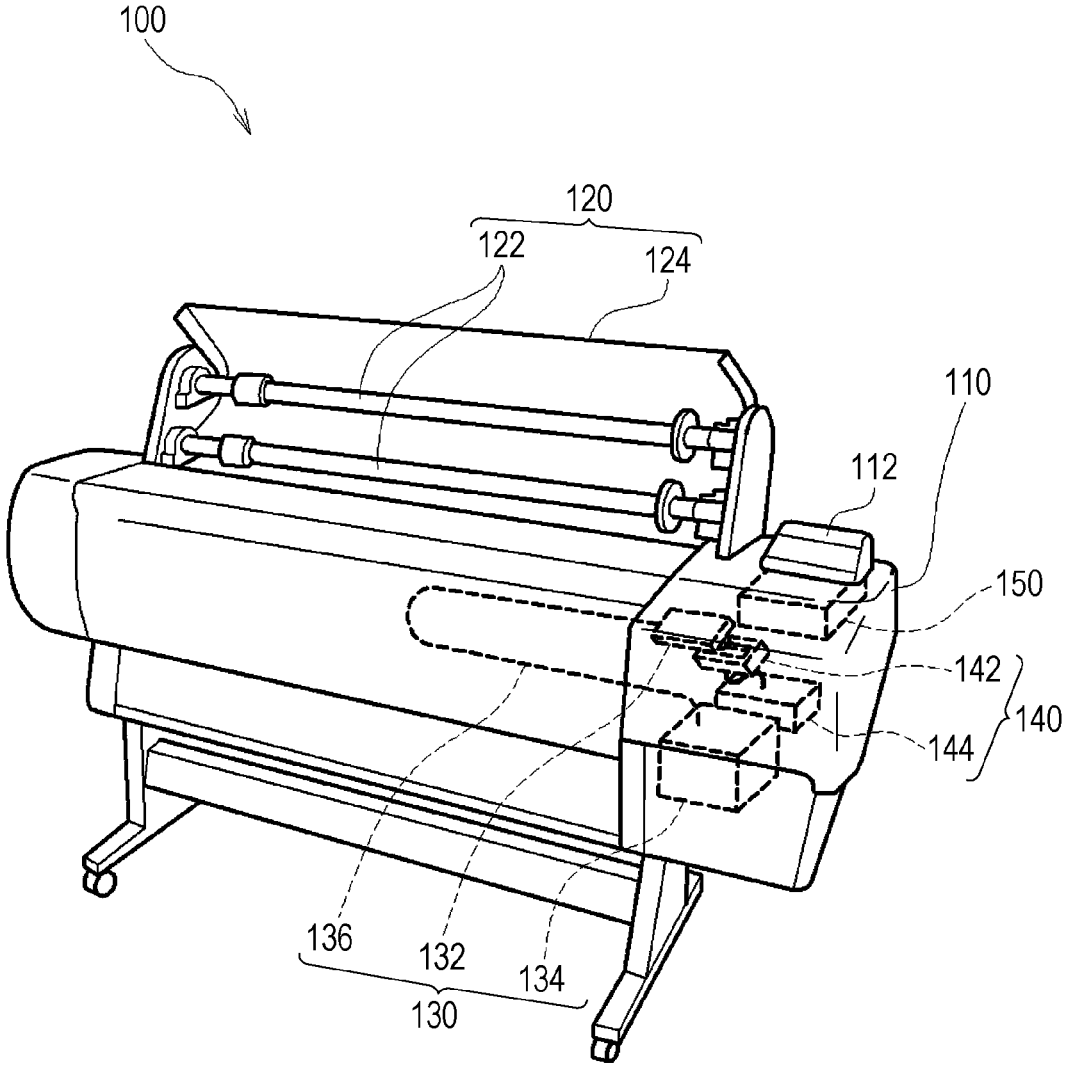
FIG. 1 is a diagram illustrating an example of an ink jet printer serving as a liquid ejecting apparatus according to an embodiment.

FIG. 1 is a descriptive diagram illustrating an example of an ink jet printer 100 serving as a liquid ejecting apparatus according to this embodiment. Although the ink jet printer 100 illustrated here is a so-called large format printer (LFP) that prints onto so-called oversized printing paper, such as JIS A1, JIS B1, or the like, the ink jet printer 100 may be a household printer that prints onto smaller-sized printing paper, such as A4, postcard size, or the like.

As shown in FIG. 1, the ink jet printer 100 is, generally speaking, configured of a main body case 110, a paper supply unit 120 that is provided on the upper surface side of the main body case 110 and into which printing paper is loaded, and the like; within the main body case 110, an ink ejection unit 130 for ejecting ink onto the printing paper, an ink maintenance unit 140 for managing the status of the ink so as to prevent the ink from drying and so on, a control unit 150 that controls the overall operations of the ink jet printer 100, and so on are installed.

The paper supply unit 120 is configured of a spindle portion 122, a cover portion 124, and so on. The spindle portion 122 is a shaft-shaped member that is supported on both ends in a rotatable state, and roll-shaped printing paper (called a "paper roll" hereinafter) is fitted thereupon. In addition, paper roll supports that are capable of sliding in the axial direction are provided on both sides of the spindle portion 122, and are capable of being fixed so that the paper roll fitted upon the spindle portion 122 does not move in the axial direction. Furthermore, the cover portion 124, which is a flip-up style, is provided in order to avoid soiling the paper roll that is fitted onto the spindle portion 122. When fitting the paper roll onto the spindle portion 122, the cover portion 124 is flipped up so as to expose the spindle portion 122, and the paper roll is fitted onto the spindle portion 122 after removing the spindle portion 122 from the paper supply unit 120. Then, after setting the spindle portion 122 onto which the paper roll has been fitted in the paper supply unit 120, the cover portion 124 is closed by pushing down on the front edge of the cover portion 124. Doing so makes it possible to prevent the paper roll that has been loaded into the paper supply unit 120 from being soiled.

The ink ejection unit 130 is configured of an ejection head 132 that ejects ink, an ink cartridge 134 in which the ink to be ejected by the ejection head 132 is held, an ink tube 136 for supplying the ink within the ink cartridge 134 to the ejection head 132, and so on. The ejection head 132 is provided with multiple fine ejection nozzles on the surface thereof that faces the printing paper, and is capable of printing text, images, or the like upon the printing paper by ejecting ink from the ejection nozzles. Note that the portion of the surface of the ejection head 132 that faces the printing paper and in which the multiple ejection nozzles are formed is called the "nozzle surface". Meanwhile, although the ink jet printer 100 uses multiple types of ink, such as cyan ink, magenta ink, yellow ink, black ink, and so on, and ink cartridges 134, ejection heads 132, and ink tubes 136 are provided for each type of ink, only a single type of ink is shown in FIG. 1 in order to avoid complicating the diagram.

The ink maintenance unit 140 is configured of a cap 142 having a concave portion formed in the center thereof, a waste ink tank 144 for holding ink that has been discharged from the ejection head 132 due to the properties of that ink having degraded, and so on. The cap 142 is capable of being pressed against the nozzle surface of the ejection head 132 and pulled away from the nozzle surface by a driving mechanism (not shown), and is in contact with the nozzle surface when the image printing is not being carried out. Doing so covers the ejection nozzles with the cap 142, thus making it possible to suppress the ink from drying through the ejection nozzles. In cases where the properties of the ink nevertheless degrade due to drying of the ink advancing, ink is ejected from the ejection head 132 into the concave portion of the cap 142, or the degraded ink is sucked from the ejection nozzles by operating a suction pump (not shown in FIG. 1) with the cap 142 pressed against the nozzle surface of the ejection head 132 and instigating negative pressure in the concave portion of the cap 142. The ink discharged from the ejection nozzles of the ejection head 132 in this manner flows into the waste ink tank 144 via a tube, and accumulates therein.

In addition, an operation panel 112 through which a user operates the ink jet printer 100 is provided on the top surface of the main body case 110. The operation panel 112 includes a display screen (not shown) configured of a liquid-crystal device or the like, various operational buttons (not shown), and so on, and the user can operate the ink jet printer 100 by manipulating the operational buttons while viewing the display screen.

Furthermore, although not shown in FIG. 1, a driving unit for moving the ejection head 132 back and forth along the surface of the printing paper, a paper feed unit for feeding paper by unrolling the paper roll in the paper supply unit 120, and so on are provided within the main body case 110.

Figure 2:
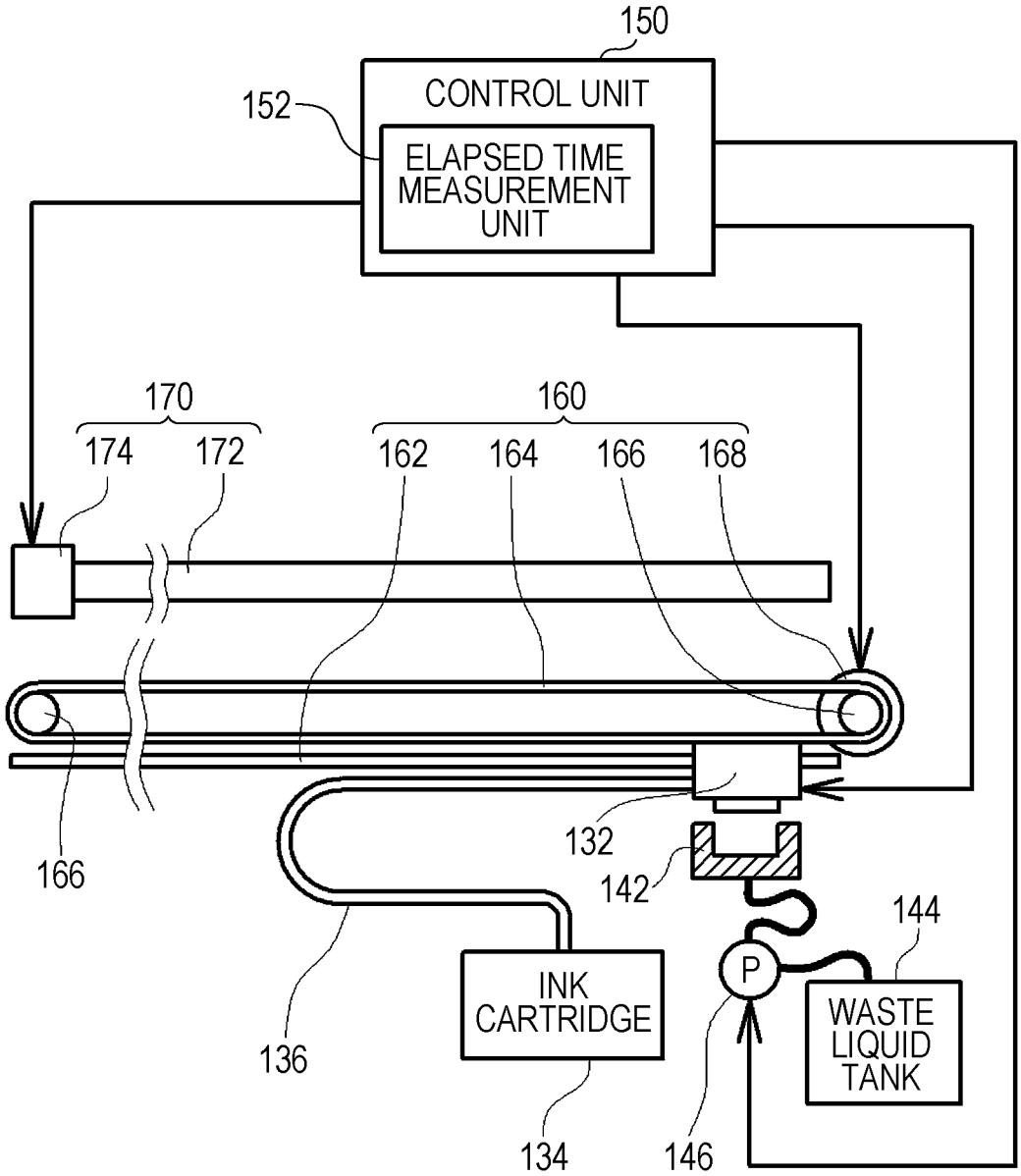

FIG. 2 is a descriptive diagram illustrating the general configuration of a driving unit 160 for moving the ejection head 132 back and forth and a paper feed unit 170 for feeding the paper roll. As shown in FIG. 2, the driving unit 160 is configured of a guide rail 162 that guides the back-and-forth movement of the ejection head 132, a driving belt 164 for moving the ejection head 132 back and forth along the guide rail 162, a pair of pulleys 166 on which the driving belt 164 is stretched, a driving motor 168 for driving the driving belt 164, and so on. The ejection head 132 is fixed in a single location on the driving belt 164, and the ejection head 132 moves back and forth while being guided by the guide rail 162 when the driving motor 168 rotates in the positive or negative direction and drives the driving belt 164.

Meanwhile, the paper feed unit 170 is configured of a paper feed roller 172 provided parallel to the guide rail 162, a paper feed motor 174 that rotates the paper feed roller 172, a slave roller (not shown) provided along with the paper feed roller 172, and so on. The paper feed roller 172 is formed of a long, cylindrical member of a length that spans the width direction of the paper roll. Meanwhile, when the paper roll is loaded into the paper supply unit 120, one end of the paper roll is unwound as far as the location of the paper feed roller 172 and inserted between the paper feed roller 172 and the slave roller. The paper roll is then in a state in which it is pressed against the paper feed roller 172 by the slave roller with an appropriate amount of force. When the paper feed motor 174 is rotated in this state, the paper roll is pulled out little by little and fed in the direction of the ejection head 132 due to the rotation of the paper feed roller 172.

The operations of the driving motor 168 and the paper feed motor 174 are controlled by the control unit 150. The operations for ejecting ink performed by the ejection head 132 are also carried out under the control of the control unit 150. Furthermore, the aforementioned operations of moving the cap 142 in order to cause the cap 142 to make contact with the nozzle surface of the ejection head 132, the operations of operating the suction pump 146 with the cap 142 pressed against the nozzle surface in order to suck ink from the ejection nozzles, and so on are also carried out under the control of the control unit 150. Accordingly, the control unit 150 is involved in almost all of the operations carried out by the ink jet printer 100, and thus when printing starts or ends, ink is ejected within the cap 142, ink is sucked, and so on, the timing thereof can be grasped in a precise manner. In correspondence with this, the control unit 150 of the ink jet printer 100 according to this embodiment is provided with an elapsed time measurement unit 152, and this elapsed time measurement unit 152 measures the amount of time that has passed since the last time printing, ejection of ink into the cap 142, ink suction, or the like was carried out.

B. Outline of Printing Operations

Figure 3A:
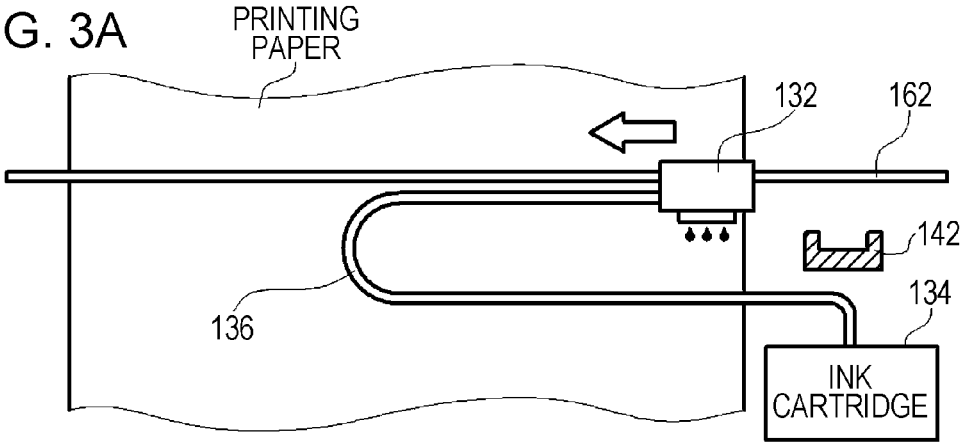
FIGS. 3A through 3C are descriptive diagrams conceptually illustrating an ink jet printer according to an embodiment printing an image while moving an ejection head back and forth.
Figure 3B:
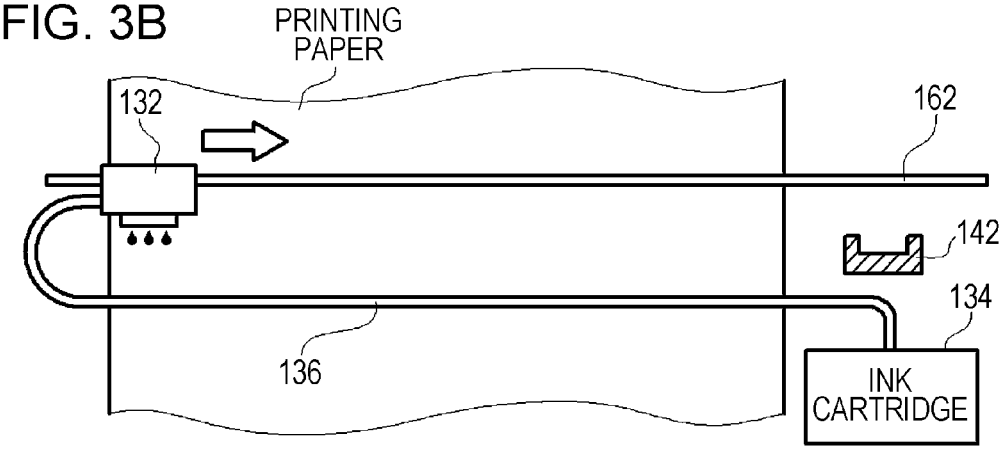
Figure 3C:
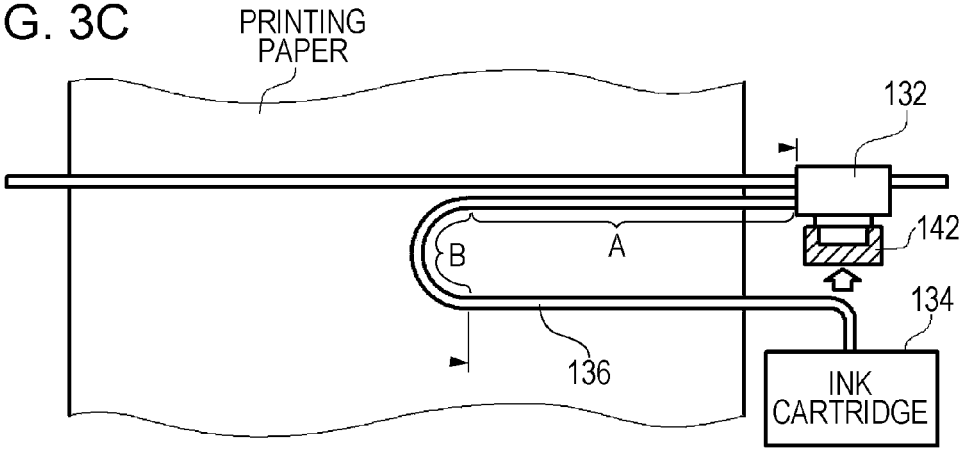

FIGS. 3A through 3C are descriptive diagrams conceptually illustrating the ink jet printer 100 according to this embodiment printing an image while moving the ejection head 132 back and forth. As shown in FIG. 3A and FIG. 3B, the ejection head 132 prints images by ejecting ink toward the printing paper (the paper roll) while moving back and forth along the guide rail 162. The ejection head 132 and the ink cartridge 134 are connected by the ink tube 136, which has a sufficient length, and ink is endlessly supplied from the ink cartridge 134 to the ejection head 132 by an ink pressurizing mechanism (not shown). Meanwhile, as shown in FIG. 3C, when printing ends, the ejection head 132 is moved to the position of the cap 142, and the cap 142 is pushed upward by a driving mechanism (not shown), thus making contact with the nozzle surface of the ejection head 132. Doing so covers the nozzle surface with the cap 142, which makes it possible to suppress a degradation in the properties of the ink caused by water, volatile components, or the like in the ink evaporating or vaporizing from the openings of the ejection nozzles, even in the case where printing is not carried out for a long period of time.

Here, when the ejection head 132 is moved to the location of the cap 142, the ink tube 136 is folded in two in the approximate center thereof, as shown in FIG. 3C. Accordingly, the ink tube 136 forms an approximately horizontal portion (the portion indicated by "A" in FIG. 3C; called a "region A" hereinafter) on the upstream side of the ejection head 132, whereas the ink tube 136 forms a portion that, compared to the region A, faces in the vertical direction (the portion indicated by "B" in FIG. 3C; called a "region B" hereinafter) of the upstream side of the region A (the side of the ink cartridge 134). Although FIG. 3C illustrates the region A being formed adjacent to the ejection head 132 and the region B being formed adjacent to the region A, it should be noted that it is not absolutely necessary for the ejection head 132 and the region A or the region A and the region B to be adjacent to each other; some sort of intermediate region, a buffer region, or the like may be formed between these two regions.

Meanwhile, although the ink is manufactured by adding various components, such as coloring materials for expressing colors, additives for adjusting the viscosity of the ink, surfactants, and so on to a liquid carrier such as water, alcohol, or the like, there are also situations where components that do not dissolve are added to the liquid carrier as well. For example, unlike a dye, a pigment, which is a coloring material having superior climate resistance, does not dissolve in water, alcohol, or the like, and thus exists in a suspended state within the liquid carrier due to the effects of a surfactant. Accordingly, if the ink is left standing for a long period of time, the pigment suspended therein gradually settles due to the influence of gravity, resulting in areas of high pigment density and areas of low pigment density. It should be noted that in this specification, components that do not dissolve in the liquid carrier of the ink and instead exist in a suspended state, such as pigment, are referred to as "sedimentary components". In addition, an ink that contains sedimentary components is referred to as "sedimentary ink", and furthermore, the settling of sedimentary components within the ink is referred to as "settling of the ink".

In the case where this type of sedimentary ink is employed, the properties of the ink degrade due not only to the drying of the ink by the evaporation or vaporization of water or volatile components within the ink but also to the settling of the sedimentary components within the ink. The negative influence caused by the settling of the ink appears more prominently in the region B in FIG. 3C than the region A. This is due to the reasons described hereinafter.

Figure 4A:
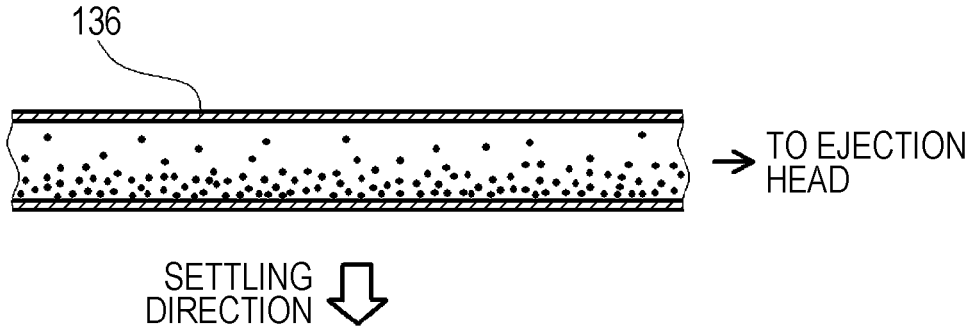
FIGS. 4A and 4B are descriptive diagrams conceptually illustrating the settling of ink occurring within an ink tube.
Figure 4B:
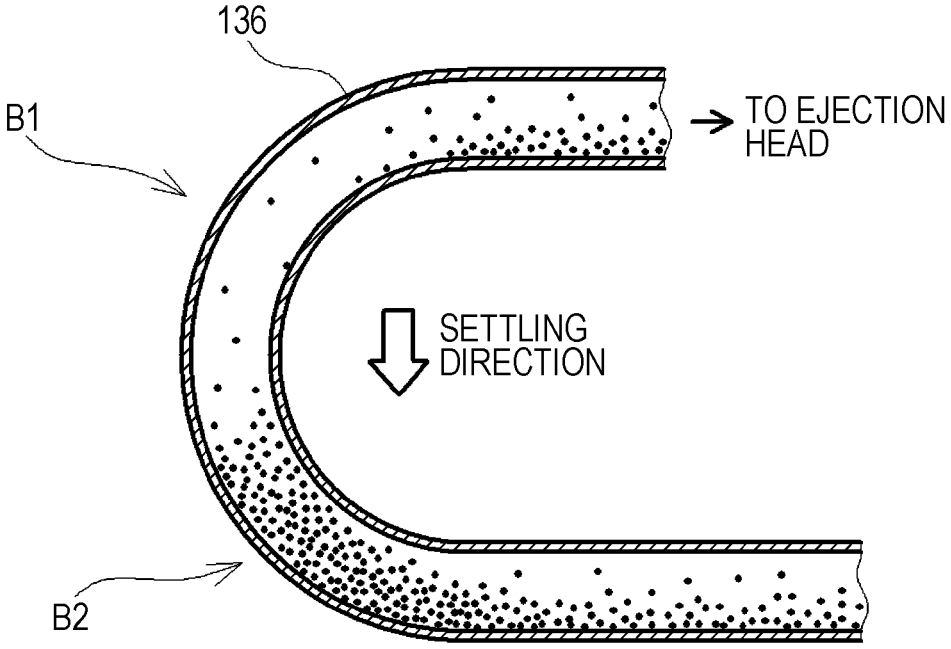

FIGS. 4A and 4B are descriptive diagrams conceptually illustrating the settling of ink occurring within the ink tube 136. FIG. 4A illustrates the settling of ink occurring within the region A of the ink tube 136, whereas FIG. 4B illustrates the settling of ink occurring within the region B of the ink tube 136.

First, the settling of ink occurring in the region A will be described with reference to FIG. 4A. As described earlier, in the region A, the ink tube 136 is oriented in approximately the horizontal direction, and thus the sedimentary components contained in the ink (pigment and the like) settle in the cross-sectional direction of the ink tube 136 (that is, a direction that is approximately perpendicular relative to the axial direction of the ink tube 136). Accordingly, an area in which the sedimentary components such as pigment are dense and an area in which the sedimentary components such as pigment are sparse occur in the cross-sectional direction of the ink tube 136. Incidentally, even if this type of non-uniform density occurs, the sedimentary components experience almost no movement in the axial direction of the ink tube 136.

As opposed to this, in the region B, the axial direction of the ink tube 136 slopes from the horizontal direction toward the vertical direction, and thus when sedimentary components such as pigment settle, those sedimentary components also move in the axial direction of the ink tube 136. Accordingly, as shown in FIG. 4B, a region B1 in which the sedimentary components have become sparse and a region B2 in which the sedimentary components have become dense arise in the region B. In other words, an area having a high sedimentary component density and an area having a low sedimentary component density arise in the axial direction of the ink tube 136.

If ink is ejected from the ejection head 132 in order to commence printing in a state in which the ink has settled in such a manner, an ink flow will occur within the ink tube 136, and this flow agitates the ink and stirs up the components that have settled. Accordingly, non-uniform densities in the cross-sectional direction of the ink tube 136 such as those that occur in the region A are eliminated comparatively quickly.

However, non-uniform densities occur in the axial direction of the ink tube 136 in the region B, and it is difficult to eliminate such non-uniformed densities using the flow of ink. This is because the cross-sectional surface of the ink tube 136 is small, and thus when the ink in the region B2 (that is, the ink that has a high component density) is moved due to the flow of ink within the ink tube 136, the ink in the region B1 (that is, the ink that has a low component density) also moves at the same time, and it is thus difficult to cause the ink in the region B2 and the ink in the region B1 to mix together.

Of course, both the ink in the region B1 and the ink in the region B2 are agitated comparatively quickly in the cross-sectional direction when an ink flow occurs within the ink tube 136. However, because agitation in the axial direction of the ink tube 136 does not advance sufficiently, the ink in the region B1 is supplied to the ejection head 132 with the sedimentary component density thereof remaining low, whereas the ink in the region B2 is supplied to the ejection head 132 with the sedimentary component density thereof remaining high. Accordingly, areas of an image that have been printed by ejecting ink that was in the region B1 are light, whereas areas of an image that have been printed by ejecting ink that was in the region B2 are dark, resulting in the occurrence of unevenness in the image. Furthermore, the ink in the region A is agitated up until that ink is supplied to the ejection head 132, and thus the sedimentary component density thereof is essentially normal. Accordingly, particularly when printing images onto large-format printing paper, even if the initial printing has been carried out normally, the image will become lighter partway through the printing and then become darker again thereafter; in addition to wasting printing paper, this results in the waste of the time required to print up until partway through.

It is therefore necessary, in order to avoid this issue, to discharge at least the ink within the region B1 and the ink within the region B2 prior to the start of printing; however, in order to do so, it is also necessary to discharge the ink within the ink tube 136 that is further downstream therefrom (that is, on the side of the ejection head 132) and the ink within the ejection head 132, which wastes a large amount of ink. Accordingly, with the ink jet printer 100 according to this embodiment, the processes described hereinafter are carried out when printing is not being performed in order to suppress, to the greatest extent possible, the amount of ink discharged due to the settling of ink.

C. Standing Ink Management Process According to the Embodiment

Figure 5:
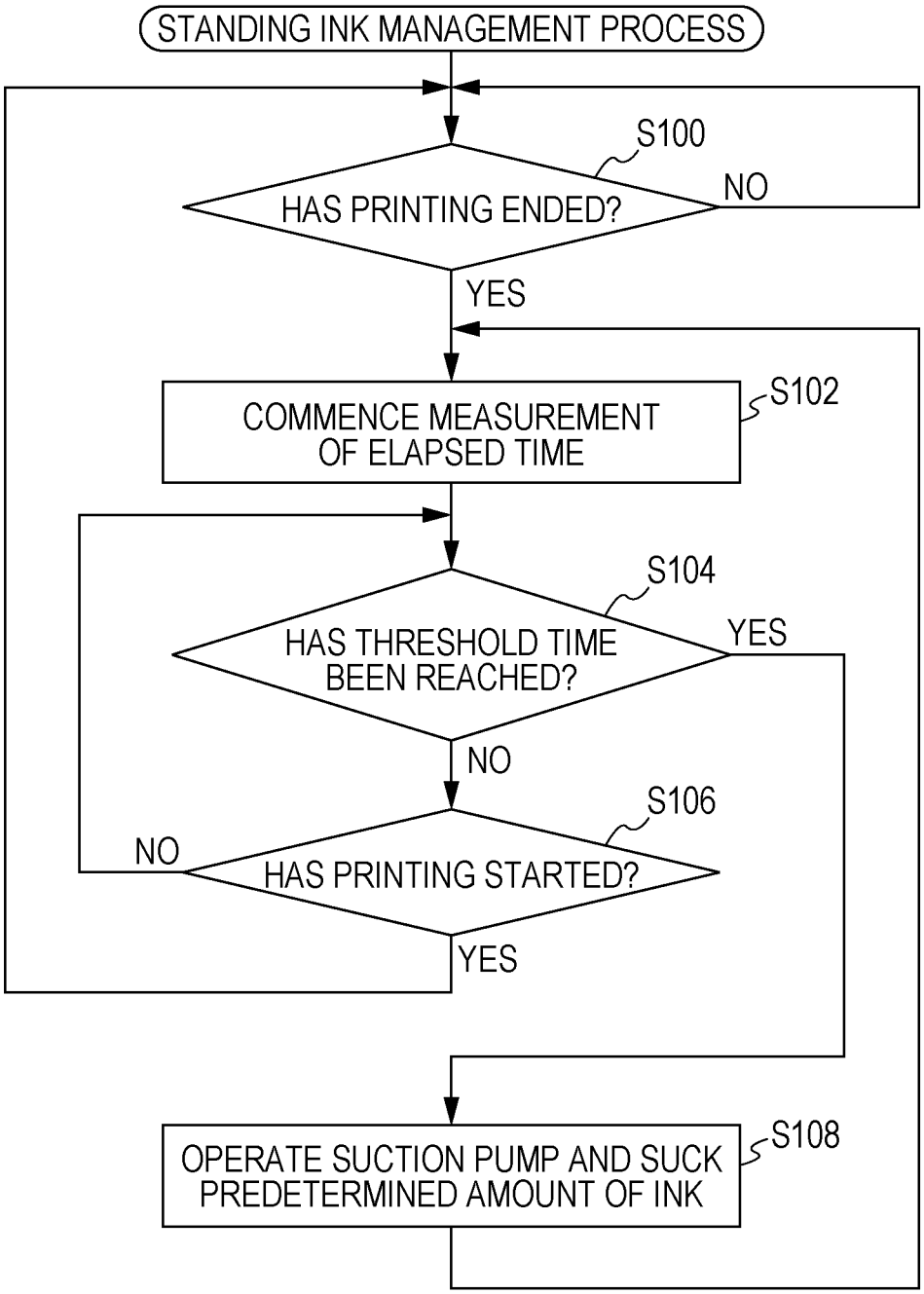
FIG. 5 is a flowchart illustrating a standing ink management process executed when an ink jet printer according to an embodiment is not carrying out printing.

FIG. 5 is a flowchart illustrating a standing ink management process executed when the ink jet printer 100 according to the present embodiment is not carrying out printing. This process is a process that is executed by the control unit 150 provided in the ink jet printer 100.

As shown in FIG. 5, in the standing ink management process, it is first determined whether or not the printing of an image has ended (step S100). Because the various operations for printing images are controlled by the control unit 150 as mentioned earlier, the control unit 150 can immediately determine whether or not the printing of the image has ended. In the case where it has been determined that the printing of the image has not ended (in other words, that printing is in progress) (step S100: no), the process enters a standby state, repeating the same determination. However, if it has been determined that the printing of the image has ended (step S100: yes), the measurement of the amount of time that has elapsed since the end of the printing is commenced by setting a timer provided in the elapsed time measurement unit 152 (see FIG. 2) (step S102).

It is then determined whether or not the measured amount of time that has elapsed since the measurement was commenced has reached a predetermined threshold time (step S104). Here, the threshold time is set to an amount of time in which the settling of the ink in the region B described using FIG. 4B will not have a negative influence on the image quality. In other words, because the ink in the region B1 shown in FIG. 4B becomes sparse and the ink in the region B2 shown in FIG. 4B becomes dense as the settling of the ink progresses, the negative influence on the image quality increases as the amount of time that has elapsed since the end of printing increases. Conversely speaking, if the amount of time that has elapsed is short, images can be printed without negatively affecting the image quality thereof. Accordingly, the amount of elapsed time in which the influence on the image quality exceeds a permissible range is found in advance using an experimental method. In the standing ink management process according to this embodiment, an amount of time that is slightly less than the amount of elapsed time obtained in this manner (that is, a permissible limit time) is set as the threshold time. Incidentally, with the ink jet printer 100 according to this embodiment, the permissible limit time obtained experimentally was 72 hours, and thus the threshold time is set to 60 hours so as to provide a small amount of leeway.

Naturally, because the amount of elapsed time has not reached the threshold time immediately after printing has ended (step S104: no), it is then determined whether or not the printing of an image has commenced (step S106). If the printing has not commenced (step S106: no), it is once again determined whether or not the amount of elapsed time has reached the threshold time (step S104). In the standing ink management process according to this embodiment, after the measurement of the elapsed time has commenced, the determination is repeated until the amount of elapsed time has reached the threshold time or the printing of the image commences.

In the case where it has been determined that the printing of the image has been commenced before the amount of elapsed time has reached the threshold time (step S106: yes), the process once again returns to the start, where it is determined whether or not the printing has ended (step S100). Once the printing has ended (step S100: yes), the timer of the elapsed time measurement unit 152 is set and the measurement of the elapsed time is commenced (step S102).

On the other hand, in the case where the amount of elapsed time has reached the threshold time without the printing of the image commencing (step S104: yes), a predetermined amount of ink is sucked from the ejection nozzles by operating the suction pump 146 (see FIG. 2) while the cap 142 is in contact with the nozzle surface of the ejection head 132 (step S108). The amount of ink (the predetermined amount) that is sucked at this time is set to an amount of ink that has approximately the same volume as the amount of ink that is present in the region B shown in FIG. 4B (and to be more precise, a slightly larger amount of ink than the ink in the region B). Meanwhile, because the amount of ink that is sucked out from the ejection nozzles of the ejection head 132 is determined by the time for which the suction pump 146 is operated, the predetermined amount of ink can be sucked by operating the suction pump 146 for a predetermined amount of time that has been set in advance.

Once the predetermined amount of ink has been sucked in this manner, the process returns to step S102 and the timer of the elapsed time measurement unit 152 is reset; the determination as to whether the amount of elapsed time has reached the threshold time (step S104) or whether the printing has commenced (step S106) is then repeated.

Note that the foregoing describes sucking out ink by operating the suction pump 146 in the case where the amount of elapsed time has reached the threshold time (step S104: yes). This is because the cap 142 is in contact with the nozzle surface of the ejection head 132 while the ink jet printer 100 is not carrying out printing in order to suppress the ink from drying through the ejection nozzles of the ejection head 132, and thus the ink can be sucked out from the ejection nozzles simply by operating the suction pump 146. However, as long as the predetermined amount of ink can be discharged from the ejection nozzles, the ink does not necessarily have to be sucked out using the suction pump 146. For example, the predetermined amount of ink may be discharged by ejecting ink from the ejection nozzles toward the cap 142 in a state in which the cap 142 is in contact with the nozzle surface of the ejection head 132 or in which the cap 142 has been temporarily distanced from the nozzle surface.

Figure 6A:
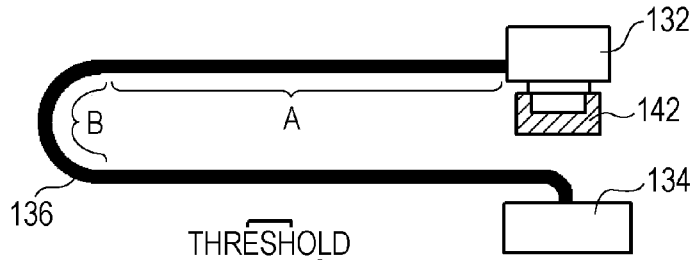
FIGS. 6A through 6E are descriptive diagrams illustrating the discharge of a predetermined amount of ink resulting from a standing ink management process according to an embodiment after a threshold time has elapsed.

FIGS. 6A through 6E are descriptive diagrams illustrating the discharge of the predetermined amount of ink resulting from the aforementioned standing ink management process after the threshold time has elapsed. FIG. 6A conceptually illustrates the state of the ink within the ink tube 136 immediately after printing has ended. No settlement whatsoever occurs in the ink within the ink tube 136 immediately after printing has ended. In FIGS. 6A through 6E, ink in which no settling has occurred is indicated by a solid black area. Ink in which some sort of settling has occurred is indicated by slanted lines. Note that at the stage indicated in FIG. 6A, the cap 142 is already in contact with the nozzle surface of the ejection head 132 in order to suppress drying of the ink through the ejection nozzles. If the ink jet printer 100 is left in such a state while printing is not carried out, the ink within the ink tube 136 will settle as time passes.

Figure 6B:
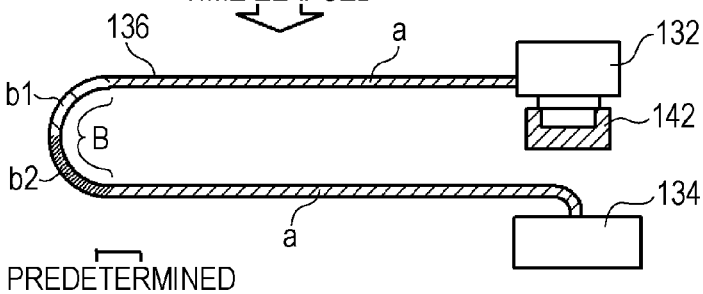

FIG. 6B conceptually illustrates the state of the ink within the ink tube 136 when the threshold time has passed without printing being carried out. In areas in which the axial direction of the ink tube 136 follows an approximately horizontal direction (in other words, the region A), ink settling has occurred in the cross-sectional direction, as described earlier using FIG. 4A. Meanwhile, in areas in which the axial direction of the ink tube 136 slopes more or less in the vertical direction (the settling direction) from the horizontal direction (that is, the region B), ink settling has also occurred in the axial direction, as described earlier using FIG. 4B; as a result, an area of low component density (the region B1 indicated in FIG. 4B) and an area of high component density (the region B2 indicated in FIG. 4B) arise in the region B.

However, the threshold time is set to be shorter than the permissible limit time as described earlier, and thus although areas of low component density and areas of high component density are present in the ink, the image quality will not be negatively influenced even if an image is printed in the state. In accordance with this, in FIG. 6B, the state of the ink in areas of low ink density in the region B is expressed as a "state b1", whereas the state of the ink in areas of high ink density in the region B is expressed as a "state b2". In other words, although the ink in the state b1 or the state b2 has a lower or a higher component density, the ink is in a state in which it does not influence the image quality. Also in accordance with this, the state of the ink present in the region A is expressed in FIG. 6B as a "state a". The ink in this state is ink in which settling has occurred in the cross-sectional direction of the ink tube 136, but that settling is not of a significantly advanced degree.

As described earlier using FIG. 5, in the standing ink management process according to this embodiment, the predetermined amount of ink is discharged from the ejection nozzles when the threshold time has elapsed (see step S108 in FIG. 5). Furthermore, the amount of ink discharged at this time (the predetermined amount) is set to be essentially the same amount of ink as the amount of ink that is present in the region B of the ink tube 136.

Figure 6C:
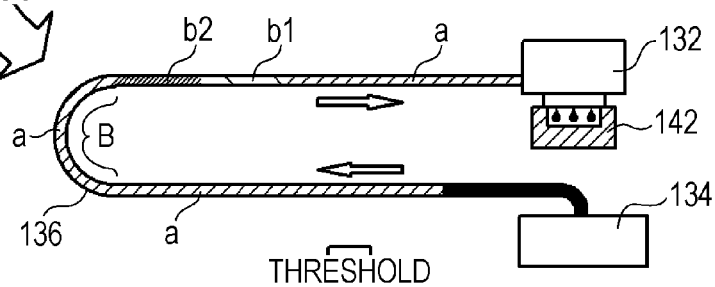

FIG. 6C illustrates a state immediately following the discharge of the predetermined amount of ink. As a result of the predetermined amount of ink being discharged from the ejection head 132, the ink that was present in the region A of the ink tube 136 (the ink in the state a) is sucked into the ejection head 132, and the ink that was present in the region B (the ink in the state b1 and the state b2) moves into an area of the region A (the area in which the ink tube 136 is approximately horizontal). In addition, ink moves into the region B, in which the ink in the state b1 and the state b2 hitherto was present, from the approximately horizontal area of the ink tube 136 that is upstream thereto. Because the ink tube 136 upstream from the region B (that is, on the side of the ink cartridge 134) is approximately horizontal, the ink that moves into the region B is ink that is in the state a. Furthermore, as described earlier using FIG. 4A, ink settling that has occurred in the cross-sectional direction of the ink tube 136 is quickly eliminated by the ink flowing in the ink tube 136, and thus the ink that moves into the region B from the area upstream thereto is ink in which the settling has actually been ameliorated to a significant degree.

Meanwhile, ink is supplied from the ink cartridge 134 to the horizontal area of the ink tube 136 that is upstream from the region B. This ink is supplied from the ink cartridge 134, and thus can be thought of as ink in which no settling whatsoever has occurred. In accordance with this, in FIG. 6C, the ink supplied from the ink cartridge 134 is indicated by the solid black area. However, due to the flow of ink, settling in the ink has been ameliorated to a significant degree even in the ink that was originally present in the horizontal area of the ink tube 136. Accordingly, the state of the ink does not actually differ significantly between the ink that is newly supplied from the ink cartridge 134 and the ink that was left standing in the ink tube 136 up until the threshold time.

As described earlier using FIG. 5, in the standing ink management process according to this embodiment, the measurement of the elapsed time is once again commenced when the predetermined amount of ink has been discharged from the ejection nozzles as described above at the point in time in which the threshold time has passed. In the case where the printing of an image has commenced before the threshold time has elapsed, the printing is commenced from the state illustrated in FIG. 6C. As a result, printing is first carried out using ink in the state a after the ink within the ejection head 132 is ejected. Although the ink in the state a has settled in the cross-sectional direction of the ink tube 136, the ink components that have settled in this direction are agitated by the flow of ink as described earlier, and thus the ink settling is eliminated by the time the ink is supplied to the ejection head 132.

As the printing continues further, the printing will eventually be carried out using ink in the state b1, after which the printing will be carried out using ink in the state b2. Although the ink in the state b1 has a low component density and the ink in the state b2 has a high component density, the density does not change significantly to a degree that will negatively influence the image quality. In addition, because the ink in the state b1 and the ink in the state b2 is left standing after moving from the region B into the region A, the ink will experience further settling in the cross-sectional direction of the ink tube 136. In other words, the ink in the state b1 settles further in the cross-sectional direction from the state in which the component density of the ink is low, and the ink in the state b2 settles further in the cross-sectional direction from the state in which the component density of the ink is high. However, because settling that has occurred in the cross-sectional direction of the ink tube 136 is eliminated by the ink flow as described earlier, at the point in time in which the respective inks are supplied to the ejection head 132, the ink in the state b1 is ink in which the ink components are uniformly mixed despite having a low component density, whereas the ink in the state b2 is uniform ink despite having a high component density. Accordingly, even if the ink settles after moving into the region A, images can be printed with almost no influence from the settling that has occurred in the region A.

Figure 6D:
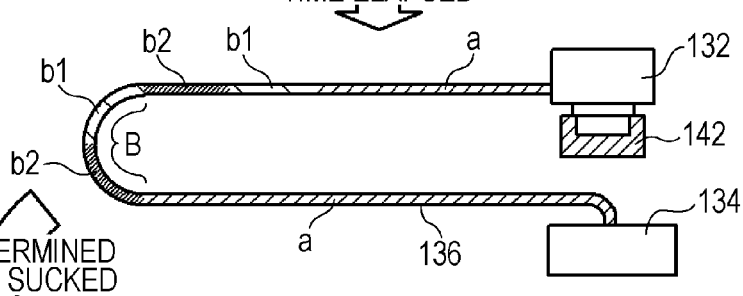
Figure 6E:
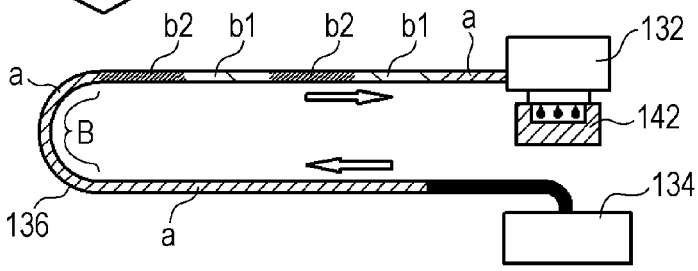

Meanwhile, if the threshold time passes from the state shown in FIG. 6C without the printing of an image being commenced, the ink in the region B settles in the axial direction of the ink tube 136, resulting in ink having a low component density (ink in the state b1) and ink having a high component density (ink in the state b2). FIG. 6D illustrates the ink settling in the axial direction of the ink tube 136 in the region B. Accordingly, a predetermined amount of ink is sucked from the ejection nozzles of the ejection head 132 by once again operating the suction pump 146. Upon doing so, ink in the state a present in the region A (the area in which the axial direction of the ink tube 136 is approximately horizontal) is supplied to the ejection head 132, and the ink in the state b1 and the ink in the state b2, which were present in the region B, move into the region A, as indicated in FIG. 6E. The ink in the state a is then supplied to the region B from upstream (that is, the side of the ink cartridge 134).

In this manner, when the ink of the region B has been moved to the region A by discharging the predetermined amount of ink from the ejection head 132, the timer of the elapsed time measurement unit 152 is once again set, and the measurement of the elapsed time commences. In the case where the printing of an image has commenced before the threshold time has elapsed, the printing is commenced from the state illustrated in FIG. 6E. As a result, printing is first carried out using ink in the state a after the ink within the ejection head 132 is ejected, after which the ink in the state b1 is used; after that, the printing is carried out using the ink in the state b2. After moving from the region B to the region A, these inks remain standing for longer than the threshold time, and thus during that time, the ink settles in the cross-sectional direction of the ink tube 136; however, because the settling that has occurred in the cross-sectional direction is eliminated to a significant degree by the ink flow, it is possible to print an image without causing a drop in image quality. Although the image is printed thereafter using ink in the state b1 and ink in the state b2, these inks have been left standing for a shorter amount of time and are also further from the ejection head 132 as compared to the ink in the state b1 and the ink in the state b2 used earlier; therefore, the influence of the ink settling on the image quality is even smaller. Meanwhile, although printing is carried out using ink in the state a as the printing continues further, the settling of this ink is eliminated by the time the ink reaches the ejection head 132, and it is thus possible to print an image without being influenced by any sort of ink settling.

Accordingly, the standing ink management process according to this embodiment responds to the occurrence of ink settling in the region B that negatively influences the image quality by focusing on the fact that settling that causes negative influence on the image quality does not occur in the region A, and the ink in the region B is moved to the region A by discharging the predetermined amount of ink before the settling of the ink in the region B has exceeded the permissible limit. If the ink that has settled in this manner is moved to the region A, even if the ink settles in the region A thereafter, that settling is eliminated by the ink flowing in the ink tube 136 during printing, and it is thus possible to print the image in a proper manner. Accordingly, even if the ink settles in the region B, it is possible to use that ink in the printing of the image rather than discarding the ink.

Of course, it is necessary to discharge the predetermined amount of ink from the ejection nozzles of the ejection head 132 in order to move the ink that has settled in the region B to the region A, and it is thus impossible to avoid wastefully discarding some ink. However, in the past, it has been necessary, in order to discard the ink that has settled in the region B, to discard all of the ink in the ink tube 136 downstream therefrom (that is, on the side of the ejection head 132) and all of the ink within the ejection head 132; on the other hand, with the ink jet printer 100 according to this embodiment, it is only necessary to discard an amount of ink that allows the ink in the region B to move to the region A (an amount that is almost equal to the amount of ink present in the region B). Accordingly, the amount of ink that is discarded rather than being used in printing can be suppressed to a great degree.

In addition, with the ink jet printer 100 according to this embodiment, the predetermined amount of ink is discharged from the ejection head 132 each time the threshold time has elapsed, and at this time, ink flows within the ink tube 136. Accordingly, the components that have settled within the ink tube 136 are agitated each time the threshold time elapses, thus eliminating imbalances in the ink components in the cross-sectional direction. Accordingly, it is possible to suppress the settling of ink from advancing not only in the region B, but also in the region A.

Figure 7:
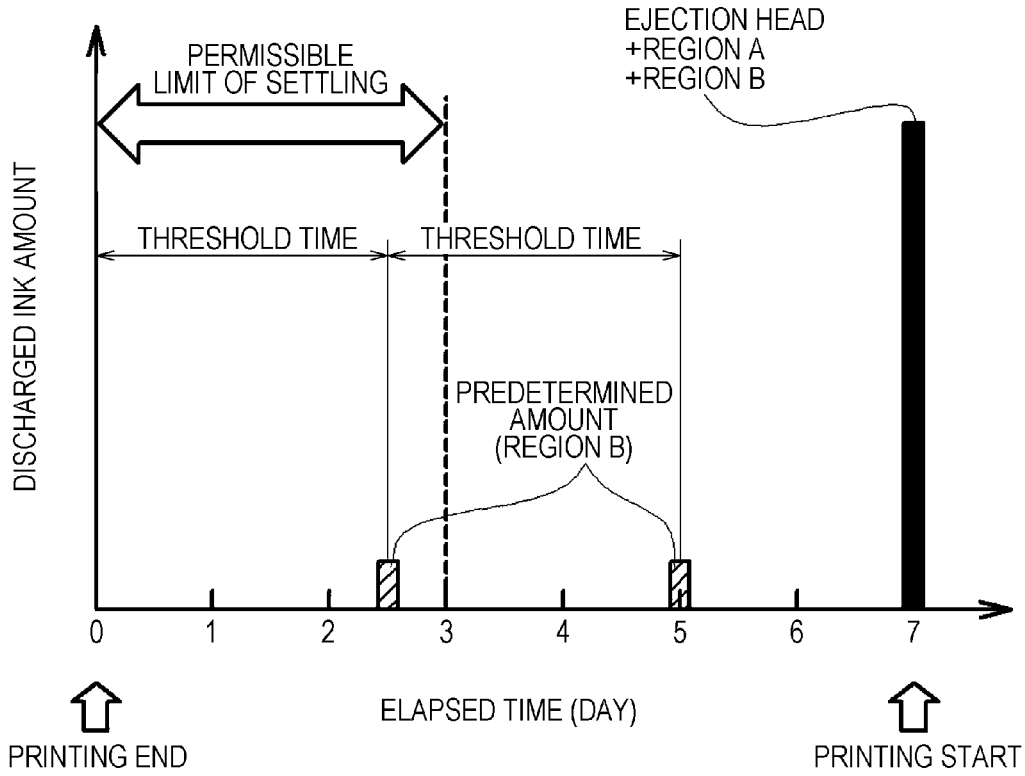
FIG. 7 is a descriptive diagram illustrating a reason why an ink discharge amount is suppressed by a standing ink management process according to an embodiment.

FIG. 7 is a descriptive diagram illustrating a reason why the ink discharge amount is suppressed by the standing ink management process according to this embodiment. Here, a case in which printing is resumed after the printer has been left standing for seven days following the end of the previous printing will be considered as an example. As described earlier, the permissible limit time after which the settling of ink will negatively affect the image quality was discovered to be 72 hours (three days) through experimentation, and thus in light of this, the threshold time is set to 60 hours (two and half days) so as to provide a small amount of leeway.

According to the standing ink management process of this embodiment described above, the measurement of the elapsed time is resumed at the point in time in which printing ended, and when the elapsed time reaches the threshold time (that is, when two and half days have passed following the end of printing), the predetermined amount of ink (which corresponds to the amount of ink present in the region B) is discharged from the ejection nozzles of the ejection head 132. In FIG. 7, the discharge amount of the ink discharged in this manner is expressed as bars that are indicated by slanted lines. As a result of discharging the predetermined amount of ink, the ink in the state b1 and the ink in the state b2 that were present in the region B move to the region A (that is, into an approximately horizontal region of the ink tube 136), and the ink in the state a is supplied to the region B from upstream (see FIG. 6C).

After this, the measurement of the elapsed time is once again commenced, and when the elapsed time reaches the threshold time (that is, when five days have passed since the printing ended), the predetermined amount of ink is once again discharged from the ejection head 132. Accordingly, the ink in the state a supplied to the region B moves to the region A at the stage at which that ink enters the state b1 or the state b2 due to the influence of settling, and after the ink in the state a has been supplied to the region B from upstream (that is, from the side of the ink cartridge 134), the measurement of the elapsed time once again commences (see FIG. 6E).

Then, seven days pass before the elapsed time reaches the threshold time, and printing commences. At this stage, the settling of the ink present in the region B has not yet advanced to the permissible limit, and furthermore, the ink that has moved to the region A downstream from the region B (that is, the side of the ejection head 132) stays in the state b1 or the state b2. Of course, the ink also settles in the cross-sectional direction of the ink tube 136 in the region A, but as described earlier, settling in this direction is quickly eliminated by ink flowing within the ink tube 136. Accordingly, even at the point in time in which seven days have passed since printing ended, it is possible to commence the printing of an image having wastefully discharged almost no ink from the ejection head 132.

As opposed to this, in the case where the standing ink management process according to this embodiment is not carried out and the ink is simply left to stand, the settling of the ink in the region B will advance to a degree that negatively influences the image quality after three days have passed following the end of printing. Meanwhile, the settling that occurs in the region B described earlier results in the sedimentary components moving in the axial direction of the ink tube 136, causing an imbalance in the component densities in the axial direction; furthermore, such an imbalance in the component densities in the axial direction will not be eliminated by the ink flowing within the ink tube 136. Ultimately, in the case where the standing time following the end of printing exceeds the permissible limit time (here, three days), there is no choice but to discard the ink in the region B; however, in order to do so, it is also necessary to discharge all of the ink in the ink tube 136 that is downstream from the region B (that is, on the side of the ejection head 132) and the ink within the ejection head 132. In FIG. 7, the discharge amount of the ink wastefully discharged in this manner is expressed as a solid black bar.

As can be understood immediately from FIG. 7, the predetermined amount of ink may be discharged after two and half and five days have passed following the end of printing in the case where the standing ink management process according to this embodiment is carried out. On the other hand, in the case where the ink has simply been left standing, it is necessary to discharge a much larger amount of ink when printing commences. In other words, carrying out the standing ink management process according to this embodiment makes it possible to greatly suppress the amount of ink that is discharged due to the settling of the ink.

It should be noted that the foregoing descriptions describe the settling of ink as occurring due to suspended components that are not dissolved in the carrier in the ink (water, alcohol, or the like) settling due to the effects of gravity. Normally, components added to ink that are in a suspended state, such as a pigment, have a larger relative density than the ink carrier, and thus it is normal for components that were suspended to sink due to gravity if the ink is left standing for a long period of time. However, there are also cases of ink being manufactured where an oil or the like is emulsified using a surfactant and suspended in the carrier of the ink. If such an ink is left standing for a long period of time, the particles of the oil or the like that were suspended rise due to ascending force, resulting in what is called "negative settling".

Figure 8A:
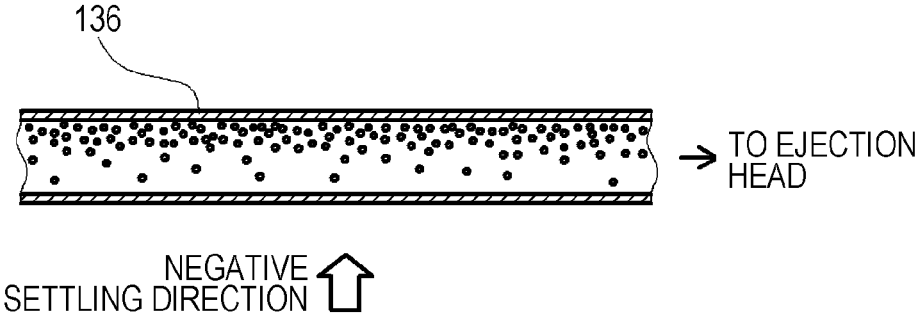
FIGS. 8A and 8B are descriptive diagrams illustrating the occurrence of negative settling within an ink tube.
Figure 8B:
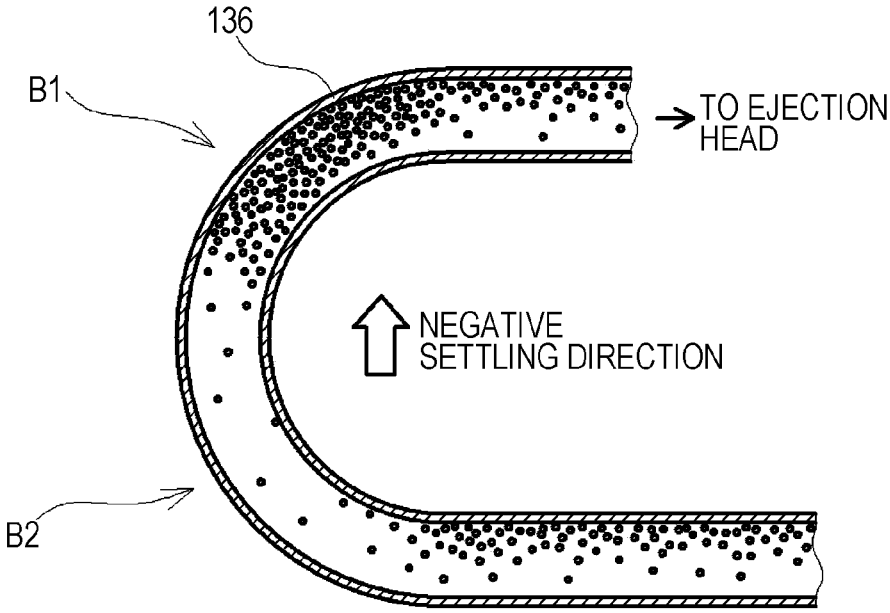

FIGS. 8A and 8B are descriptive diagrams illustrating the occurrence of negative settling within the ink tube 136 of the ink jet printer 100. In the case illustrated in FIGS. 4A and 4B and described earlier, what is known as "positive settling", in which the sedimentary components have a larger relative density than the ink carrier and thus move downward due to gravity, occurs; however, in the example illustrated in FIGS. 8A and 8B, the sedimentary components (or to be precise, the components having negative sedimentary properties) have a lower relative mass than the ink carrier and thus move upward due to ascending force. Accordingly, as shown in FIG. 8A, in the approximately horizontal region A of the ink tube 136, areas of high component density and areas of low component density arise in the cross-sectional direction of the ink tube 136. Meanwhile, as shown in FIG. 8B, in the region B, areas of high component density and areas of low component density arise in the axial direction of the ink tube 136.

As can be seen by comparing the negative settling illustrated in FIGS. 8A and 8B and the positive settling illustrated in FIGS. 4A and 4B, although the areas of high component density and areas of low component density are inverted, the exact same phenomenon occurs in the ink within the ink tube 136 both in the case where negative settling has occurred and the case where positive settling has occurred. Accordingly, the descriptions given earlier regarding ink in which positive settling has occurred apply in exactly the same manner to ink in which negative settling has occurred. Accordingly, even in the case where negative settling has occurred, carrying out the standing ink management process according to this embodiment makes it possible to greatly suppress the amount of ink that is discharged.

Although the foregoing has described embodiments and variations of the invention, the invention is not intended to be limited to the foregoing descriptions, and the invention can be carried out in various other forms without departing from the essential spirit thereof.

What is claimed is:

1. A liquid ejecting apparatus that ejects a liquid containing a sedimentary component from an ejection nozzle provided in an ejection head, the apparatus comprising:

a liquid holding receptacle in which the liquid is held;

a liquid channel that conducts the liquid within the liquid holding receptacle to the ejection head, the liquid channel that is provided with a first channel region in which the channel direction of the liquid channel is formed in a direction approximately perpendicular to the direction in which components in the liquid settle and a second channel region, located upstream from the first channel region, in which the channel direction of the liquid channel is formed, compared to the first channel region, along the direction in which components in the liquid settle;

a liquid discharge unit that discharges the liquid within the ejection head from the ejection nozzle; and a time measurement unit that measures the amount of time that has elapsed following the ejection or the discharge of the liquid, wherein the liquid discharge unit is a unit that moves liquid that has settled in the second channel region to the first channel region and leaves the liquid that has settled in the second channel region in the first channel region, by discharging a predetermined amount of the liquid that has settled in the first channel region from the ejection nozzle in the case where the amount of time that has elapsed as measured by the time measurement unit has reached a predetermined threshold time.

2. The liquid ejecting apparatus according to claim 1, wherein the total volume within the liquid channel downstream from the second channel region and within the ejection head is set to be a greater volume than the volume within the second channel region.

3. The liquid ejecting apparatus according to claim 1, further comprising:

a cap member that makes contact with a nozzle surface in which the ejection nozzle is formed in the ejection head and that forms a closed space around the ejection nozzle; and a suction pump that is connected to the cap member and that instigates negative pressure within the closed space, wherein the liquid discharge unit is a unit that discharges the liquid by operating the suction pump in a state in which the cap member is in contact with the nozzle surface and sucking the liquid from the ejection nozzle.

* * * * *